United States Patent [19]

Farris, Jr.

[11] 3,975,119

[45] Aug. 17, 1976

[54] DIAPHRAGM PUMP HAVING AUXILIARY CHAMBER

[76] Inventor: Clyde A. Farris, Jr., 856 Lovell Road, Knoxville, Tenn. 37919

[22] Filed: Sept. 17, 1975

[21] Appl. No.: 614,316

[52] U.S. Cl. ..... 417/434

[51] Int. Cl.[2] ..... F04B 39/00

[58] Field of Search ..... 417/434, 568, 413; 251/264, 349

[56] References Cited

UNITED STATES PATENTS

| | | | |
|---|---|---|---|
| 2,203,828 | 6/1940 | Larson | 417/434 |
| 2,295,774 | 9/1942 | Corydon | 417/568 |
| 2,555,627 | 6/1951 | Baker | 251/349 |
| 2,916,998 | 12/1959 | Miller | 417/568 |
| 3,153,347 | 10/1964 | Scholze | 417/413 |
| 3,529,805 | 9/1970 | Callahan, Jr. | 251/264 |

FOREIGN PATENTS OR APPLICATIONS

| | | | |
|---|---|---|---|
| 454,928 | 2/1950 | Italy | 417/413 |

*Primary Examiner*—William L. Freeh
*Attorney, Agent, or Firm*—Fitch, Even, Tabin & Luedeka

[57] ABSTRACT

An improved diaphragm pump including motor driven reciprocating means secured at its outboard end to a flexible diaphragm spanning a pump cavity defined by a pump head including an integrally formed auxiliary chamber provided with valve means adapted to depressurize the pump cavity and the downstream side of the pumping system and to drain the downstream side of the system preparatory to dismantling the pump.

7 Claims, 3 Drawing Figures

DIAPHRAGM PUMP HAVING AUXILIARY CHAMBER

This invention relates to diaphragm pumps and more particularly to a diaphragm pump including an auxiliary chamber including a depressurization and drain feature.

In general, diaphragm pumps include a motor or electromagnetically driven reciprocating plunger secured to the central portion of a flexible diaphragm which is operably disposed within a pump cavity. On the back stroke the plunger distends the diaphragm to create a vacuum, causing liquid to flow into the pump cavity through an inlet valve, usually a check valve. On the forward stroke the plunger distends the diaphragm in the opposite direction forcing the liquid in the cavity through an outlet valve (also usually a check valve) to a desired remote location. During the forward stroke, the inlet valve is closed, thereby preventing the fluids in the cavity from flowing back through the passage operated by the inlet valve. Similarly, during the back stroke, the outlet valve is closed.

Diaphragm pumps are particularly suited for pumping acids, fruit juices and other corrosive liquids since the impervious and inert diaphragm isolates the corrosive liquids from the moving parts of the pump. Conversely, the valves, pump cavity, and diaphragm are in continuous contact with the corrosive liquids passing through the pump, hence, periodic replacement of one or more of these parts is required. To replace the pump valves or the diaphragm, the pump must be partially disassembled.

In a pumping system including a diaphragm pump having check type inlet and outlet valves, after a period of pumping, liquid is moved into the outlet side of the system where it is present under pressure. More specifically, in a diaphragm pump, during the forward stroke of the diaphragm, liquid is expelled from the pump cavity through the outlet check valve into a conduit leading to some desired remote location where the liquid is dispensed. In the usual situation, the liquid on the outlet side, that is downstream, of the pump is under pressure even when the pump is inactivated and poses a potential threat to a repairman when the pump is dismantled for repair, etc. In the event the pump is stopped on its forward stroke, the pressure on the outlet side of the pump may be even greater by reason of the pressure built up within the pump cavity by the distended diaphragm. In this latter situation, if the outlet side of the pumping system is opened to atmosphere for repair purposes, there is an increased danger that the liquid disposed on the outlet side of the system will be released under pressure with resultant possible injury. Heretofore, there has been no known means by which the outlet side of the pump and the pump cavity can be depressurized, and the liquid on the outlet side of the pump substantially completely drained from the system, including the liquid expelled from the cavity by reason of the distended diaphragm moving an additional amount after the pressure on the outlet side of the pump has been reduced to atmospheric pressure. Whereas it is recognized that relatively small amounts of liquid may be involved in many instances, it is to be noted that such liquids may be highly corrosive and/or injurious to persons or adjacent physical structure so that extreme care must be exercised in their handling. As a consequence, it is highly important in many applications that the outlet side of the system be depressurized and drained of substantially all liquid prior to the operator opening the pump for repair purposes or the like.

It is therefore an object of this invention to provide an improved diaphragm pump. It is another object of this invention to provide a diaphragm pump having an auxiliary chamber including a depressurization and drain feature. Other objects and advantages of the invention will become apparent by reference to the following description including the accompanying drawings in which.

In accordance with the present disclosure, there is provided a diaphragm pump including motor driven reciprocating means secured at its outboard end to a flexible diaphragm spanning a pump cavity in a pump head provided with inlet and outlet check valve means adapted for responding to the reciprocating movement of the diaphragm to control the flow of a liquid through the pump. An auxiliary chamber is integrally formed with the pump head and includes valve means to provide regulated fluid communication between the pump outlet and a remote depository for depressurizing the pump cavity and for simultaneously depressurizing and draining the downstream side of the system before the system is disassembled for reparation purposes or the like.

Figure 1:
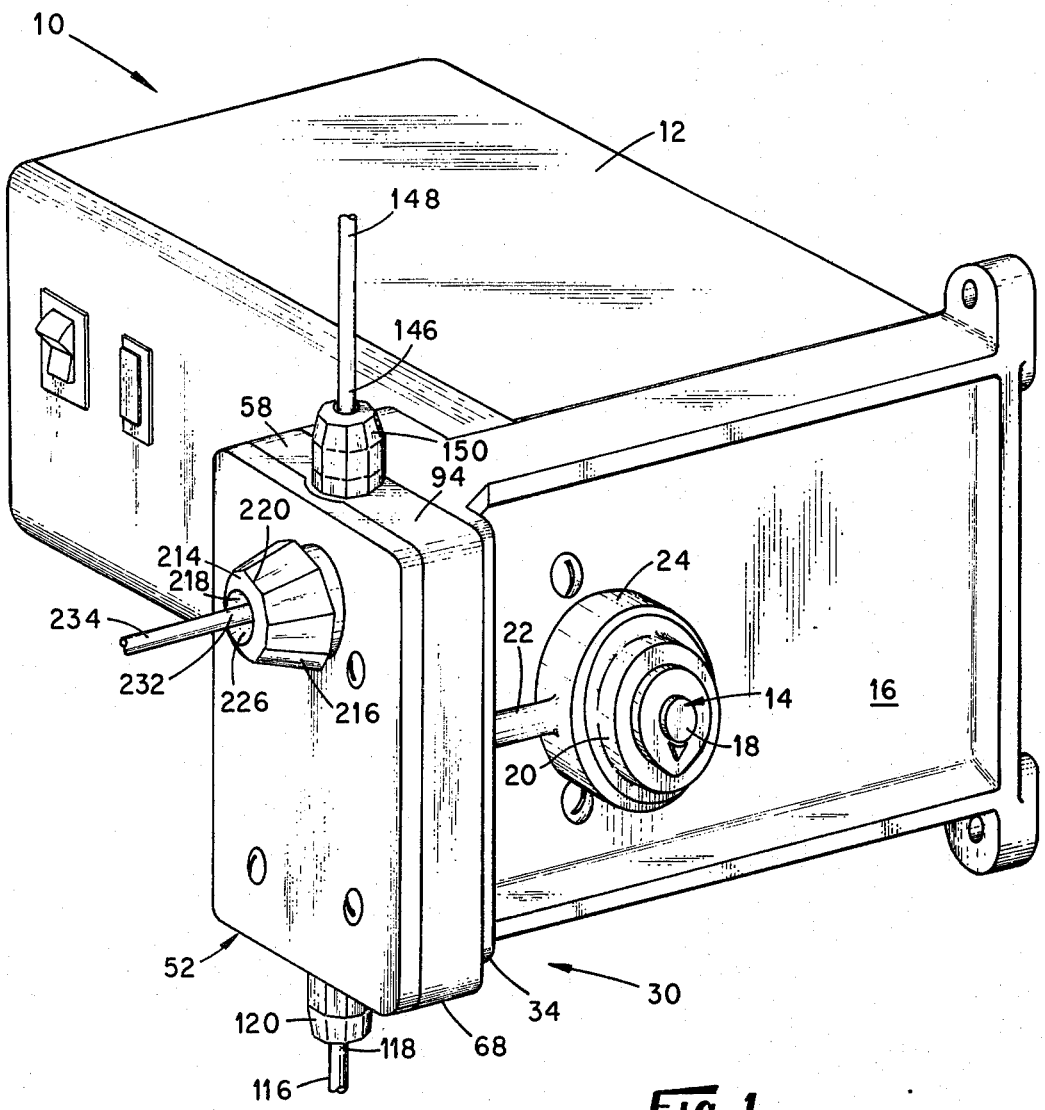
FIG. 1 is a perspective view of a diaphragm pump system showing various features of the invention.

Referring to the Figures, a diaphragm pump system generally referred to at 10 is shown in FIG. 1 and includes a motor means 12 having shaft means 14 extending therefrom through a pump housing 16 to receive on its outboard end 18 and eccentric 20 adapted for rotation with the shaft 14. A connecting rod 22 is journaled at one of its ends 24 about the eccentric 20 such that rotational movement of the eccentric 20 causes displacement of the opposite and outboard end 26 of the connecting rod laterally with respect to the rotational axis of the shaft 14. Such outboard end 26 of the rod 22 is secured to the central portion of a flexible diaphragm 28 mounted on a pump head 30 and spanning a generally concave pump cavity 32 defined in one surface of the pump head. The pump head is mounted on a planar base 34 which in the depicted embodiment is integrally formed with the pump housing 16. In the illustrated embodiment, the pump cavity 32 is formed in one surface 38 of the pump head and is provided with an annular depression 40 suitable to receive therein the peripheral edge 42 of the diaphragm 28. When the pump head 30 is secured to the base 34, that portion of the diaphragm disposed in the annular depression 40 is captured and held in sealing relation between the base 34 and the surface 38 of the pump head 28 such that the diaphragm spans the pump cavity. The base 34 is provided with a central opening 44, adapted for receiving the connecting rod 22 therethrough and proportioned for receiving the distended diaphragm secured to the outboard end of the connecting rod during the down stroke of the connecting rod. Thus, the back side 45 of the diaphragm is open to atmospheric pressure. As shown, the sealing of the diaphragm between the base 34 and the pump head 30 is enhanced by providing a raised annular ring 46 within the annular depression 40.

In the preferred embodiment, the pumped liquid is exposed only to the diaphragm and the pump head 30 with its inlet valve 46 and outlet valve 48 so that only these members need be corrosion resistant. This is accomplished by providing an inlet 50 on one side 52 of the pump head 30 including a channel 54 leading to the pump cavity, and by providing an outlet 56 on an opposite side 58 of the pump head which includes a channel 60 leading through the pump head into the pump cavity.

As shown in the Figures, the inlet 50 comprises a chamber 62 integrally formed with the pump head 30 and includes an inlet opening 64 which is substantially flush with the face 66 of the wall 68 of the head. The internal wall 70 of the chamber 62 includes a substantially smooth section 72 extending from the inlet opening 64 to a circumferential shoulder 73 that serves as a stop for an O-ring 74 to be further described hereinafter. An internally threaded section 76 of the wall 70 extends inwardly from the circumferential shoulder 73 and terminates adjacent the base portion 78 of the inlet chamber, such base portion 78 including a further smooth cylindrical wall portion 80 of lesser diameter than the threaded section 76. This further smooth wall section 80 terminates at a still further, and concentric, smooth wall portion 84 of still lesser diameter to define an annular shoulder 82. This wall portion 84 terminates at a wall portion 85 which opens into the inlet channel 54 thereby defining an annular shoulder 86 that serves as a support for the end of a compression spring 88.

Figure 2:
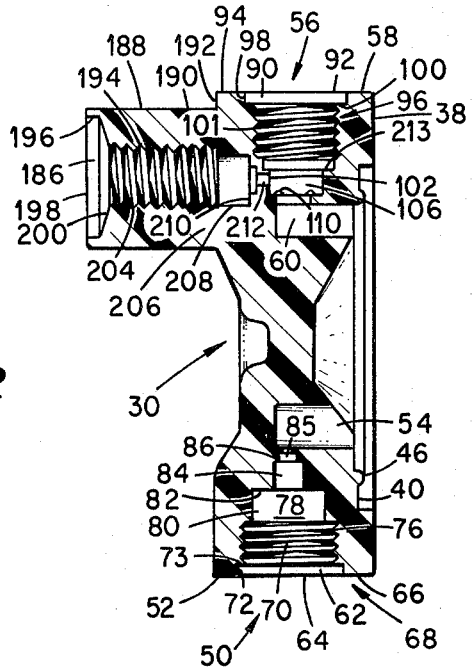
FIG. 2 is a sectional view of a pump head as shown in FIG. 1.

In a related manner, an outlet chamber 90 is integrally formed in the opposite side of the head 30 and diametrically across the pump cavity from the inlet 50. As shown in FIG. 2, the outlet chamber includes an outlet opening 92 which is flush with a wall 94 of the head 30 and includes an interior wall 96 having a substantially cylindrical smooth section 98 which extends from the outlet opening 92 to a circumferential shoulder 100. An internally threaded wall section 101 extends from the circumferential shoulder 100 to a further smooth cylindrical wall section 102 near the base 106 of the outlet chamber 90. This further wall section defines a recess for receiving an O-ring 108 defining a valve seat 110 for the inlet valve. The channel 60 provides fluid communication between the outlet chamber 90 through the head 30 to the pump cavity 32.

Each of the inlet and outlet chambers 62 and 90, respectively, is provided with fitting means adapted to be threadably received in the respective chamber to provide fluid communication between the chamber and external conduit means. The illustrated inlet fitting means 112 includes an upper portion having a tapered nozzle 114 proportioned for insertion into the end of an inlet conduit 116 which is in fluid communication at its opposite end with a reservoir of liquid, for example. That end 118 of the conduit fitted onto the nozzle 114 is secured by an internally threaded flare nut means 120 which crimps the end 118 of the conduit against the outer wall of the nozzle 114 to form a seal therebetween. A central portion of the inlet fitting 112 defines a nut shaped section 121 adapted to be engaged by wrench means when inserting or removing the fitting means 112 from the inlet chamber 62. A base portion 122 of the inlet fitting includes an annular groove 124 proportioned to receive an O-ring 74. The remainder of the outer wall 126 of the base portion 122 is externally threaded and adapted to be received in the internally threaded inlet chamber 62. In the illustrated embodiment, the O-ring 74 is received within and in sealing engagement with the smooth wall section 72 of the inlet chamber, the O-ring further engaging the shoulder 73 in sealing engagement to prevent the flow of liquid from the inlet chamber outwardly through the space between the fitting and the interior wall of the inlet chamber.

The inlet fitting is internally bored along its axis to define a passageway 126 therethrough having a substantially circular cross section. The terminal end 128 of the passageway 126 is provided with a circumferential shoulder 130 adapted to receive an O-ring 132 which circumscribes the passage 126 and serves as a seat for a spherical closure member 134 for the inlet valve.

As mentioned above, one end 136 of a compression spring 88 is disposed in a receptacle defined by a smooth wall section 84 of the inlet chamber 62. The opposite end 138 of the compression spring 88 engages a spherical closure member 134 proportioned to be received in sealing engagement with the seat 140 defined by the O-ring 132. The spring 88 is adapted to urge the closure member 134 against the seat 140 except during those times when the forces acting upon the closure member 134 overcome the compressive force exerted by the spring and cause the closure member to move away from the seat to open the passage 126 for liquid flow therethrough. As will appear more fully hereinafter, in the depicted embodiment, such action occurs only during the back stroke of the diaphragm so that the inlet valve performs as a check valve.

The illustrated outlet fitting means 142 includes an upper portion having a tapered nozzle 144 proportioned for insertion into the end 146 of an outlet conduit 148 adapted to deliver pumped liquid to a desired remote location. The outlet fitting 142 is substantially like the aforementioned inlet fitting 112. That end 146 of the outlet conduit fitted onto the nozzle 144 is secured by an internally threaded flare nut 150 which crimps the end 146 of the conduit against the outer wall of the nozzle 144 to form a seal therebetween. The central portion of the outlet fitting defines a nut-shaped section 152 adapted to be engaged by wrench means when inserting or removing the fitting means 142 from the outlet chamber 90. The base portion of the inlet fitting includes an annular groove 154 proportioned to receive an O-ring which is received within and in sealing engagement with the smooth wall section 98 of the outlet chamber 90, the O-ring 156 further engaging the shoulder 100 in sealing engagement to prevent the flow of liquid from the outlet chamber through the space between the fitting 142 and the chamber 90 to the outside of the chamber 90. The base portion 158 extends from the annular groove 154 through an externally threaded section 159 to a smooth section 160 at the terminal end of the fitting 142 and is adapted to be received in the internally threaded inlet chamber 90.

The internal wall 162 of the outlet fitting, defining a passage 164 therethrough, includes a substantially smooth section 166 extending from a nozzle opening 168 to a circumferential shoulder 170 that serves as a seat for the end of a compression spring 172 to be further described hereinafter. A further substantially smooth section of greater diameter extends from this shoulder 170 to another smooth cylindrical wall portion 174 of still greater diameter defining a further annular shoulder 176 at the juncture of these two wall sections. This last mentioned wall section 174 terminates at a base opening 178, and serves as a guide for a spherical valve member 180 engaged by the compression force of the spring 172 acts against the spherical valve member 180 to urge it into sealing engagement with the valve seat 110 in the manner of a check valve to maintain the passage closed as fluid is drawn into the pump cavity 32 during the backstroke of the diaphragm 28.

An auxiliary chamber 186 is integrally formed with the pump head 30 and extends substantially perpendicularly from the base portion 106 of the outlet chamber 90. This auxiliary chamber 186 is in fluid communication with the outlet chamber 90. The illustrated auxiliary chamber 186 includes a smooth cylindrical outer wall 188 integrally formed at its inboard end 190 with the outer wall 192 of the outlet chamber 90 as shown in FIG. 2. The internal wall 194 of the chamber 186 defines a substantially smooth section 196 extending inwardly from an external opening 198 to a circumferential shoulder 200 that serves as a stop for an O-ring seal 202 to be further described hereinafter. An internally threaded section 204 of the wall 194 extends inwardly from the circumferential shoulder 200 and terminates adjacent a base portion of the auxiliary chamber 186, such base portion 206 including a further smooth cylindrical wall portion 208 of lesser diameter than the threaded section 204. This further smooth wall section 208 terminates in a passage 212 of lesser diameter thereby defining an annular shoulder 210 at the juncture of these two wall sections. This passage 212 extends into the outlet chamber 90 and terminating in the smooth interior wall section 102 adjacent the circumferential shoulder 213.

Figure 3:
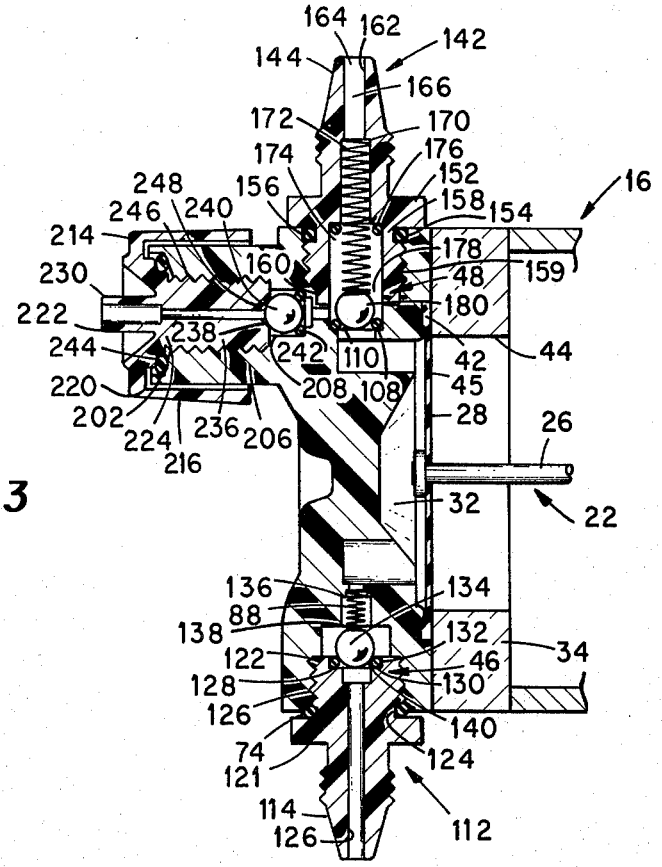
FIG. 3 is a plan view of the pump head as shown in FIG. 1.

As illustrated in FIG. 3, flange cap means and auxiliary valve means are provided for opening and closing the passage 212 interconnecting the base of the auxiliary chamber with the outlet chamber. The flange cap means 214 includes a generally conically shaped flare nut portion 216 having a web 218 extending inwardly from the outboard rim 220 of the cap to provide the means for mounting a central conduit 222 concentrically within the cap and spaced inwardly apart from the internal wall 224 of the cap to define a space 220 therebetween into which the wall 188 of the auxiliary chamber 90 is received when the cap 214 is applied. The outboard end 230 of the conduit 222 receives one end 232 of a drain conduit 234 which communicates at its opposite end with a remote depository. The inboard end 236 of the conduit is externally threaded to be threadably received in the internally threaded section 204 of the auxiliary chamber 186. The inboard end 236 of the conduit 222 terminates in a grooved concavity 238 adapted for engaging a valve member 240 which in the illustrated embodiment is spherical and disposed in the auxiliary chamber 186 adjacent the O-ring 242 and captured between such O-ring and the concavity 238. As noted above, the chamber wall 188 is received within the space 220 when the flange cap means is threadably advanced into the auxiliary chamber 186. A circumferential shoulder 244 is provided on the outer wall 246 of the conduit 222 adjacent the juncture of the web 218 with the conduit 222 and is adapted to receive an O-ring 202 which sealably engages the smooth wall section 196 of the auxiliary chamber 186 and which further engages the shoulder 200 in sealing engagement to prevent the flow of liquid from the auxiliary chamber to the exterior of the chamber 186.

As appears from the preceding discussion, the passage 212 providing fluid communication between the outlet chamber 90 and the auxiliary chamber 186 is opened or closed by threadably advancing or retracting the cap 214 onto the wall 194 of the auxiliary chamber 186 to sealably position the spherical valve member 240 within the O-ring valve seat. When the passage 212 is opened, as by threadably withdrawing the cap, fluid flowing through the passage 212 from the outlet chamber 90 enters the auxiliary chamber 186 and exits the same through a plurality of grooves 248 provided in the concave inboard end 236 of the conduit 222 thereby providing for fluid flow while still retaining the spherical valve member 240 in position to sealably engage its cooperating O-ring 242.

In operation, the motor driven reciprocating means distends the diaphragm rearward in a back stroke, creating a vacuum in the pump cavity which acts upon the spherical closure member of the inlet chamber with a force greater than the compressive force of the associated spring disposed in the inlet chamber. This vacuum force displaces the spherical closure member in the inlet chamber away from the O-ring seal in the base of the inlet fitting and draws liquid through the inlet conduit and into the pump cavity. The O-ring seal carried by the inlet fitting forms a seal with the smooth wall section adjacent the chamber opening and prevents liquid from escaping the confines of the inlet chamber and inlet fitting. In the same motion of the reciprocating means the spherical valve member disposed in the outlet chamber is positioned and maintained in sealing engagement with the O-ring seal at the base of the outlet chamber by the combined forces exerted by the vacuum and the associated compression spring to close the outlet and prevent the back flow of liquid (or air) from the downstream side of the pump into the cavity.

As the force of the vacuum in the cavity is reduced near the termination of the back stroke and commencement of the forward stroke, the inlet spherical closure member is advanced into the O-ring seal disposed in the base of the inlet fitting to close the inlet. During the forward stroke, the reciprocating means distends the diaphragm in the opposite direction, i.e., into the pump cavity, to pressurize the pump cavity. This force acts against the inlet spherical closure member to maintain its sealing relation with the O-ring seal positioned in the base of the inlet fitting thereby closing the inlet to prevent back flow of liquid during the forward stroke. In the same motion, this pressurization generates a force that exceeds the force of the compression spring holding the outlet spherical valve member in the O-ring seal at the base of the outlet chamber and thereby displaces the outlet spherical member away from the outlet O-ring seal, opening the outlet and forcing liquid from the pump cavity through the outlet conduit to a remote location. Near the end of the forward upward stroke the outward force exerted upon the outlet spherical member is exceeded by the inward force exerted by the associated compression spring and the spherical valve member is returned to the O-ring seal at the base of the outlet chamber to close the outlet passage. This process is repeated and liquid is pumped from the reservoir of liquid to a remote location until the motion of the reciprocating means is terminated.

In accordance with the present disclosure, reparation of the pump is facilitated by the provision of an auxiliary chamber and its valve means for depressurizing the outlet side of the pump and the pump cavity and for draining the outlet side of the pump. During normal operation of the pump, the passage interconnecting the outlet chamber and the auxiliary chamber is closed through selecting the threaded position of the cap 214, hence the spherical valve member 240. In this situation the grooved concavity at the end of the flange cap conduit 222 which is threadably received by the auxiliary chamber engages and maintains the spherical valve member in sealing relation with the O-ring seal in this chamber. Before dismantling the pump for reparatory purposes, or the like, the flange cap conduit 222 which is threadably received by the auxiliary chamber engages and maintains the spherical valve member in sealing relation with the O-ring seal in this chamber. Before dismantling the pump for reparatory purposes, or the like, the flange cap is partially retracted from the auxiliary chamber thereby withdrawing the end 236 of the conduit 222 from its position of pressurized engagement with the spherical valve member 240 and opening the passage leading from the outlet chamber into the auxiliary chamber. This results in depressurization of the outlet chamber 90 (and the outlet conduit 148) and flow of liquid through the auxiliary chamber, around the spherical valve member and through the grooves in the concavity at the end of the conduit member into the drainage conduit leading to a remote depository. Notably, the passage 212 is located immediately adjacent the O-ring valve seat 110 so that any fluid disposed in the outlet chamber 90 and/or in the outlet conduit 148 will drain by gravity or under the influence of any pressure existing in the outlet chamber. Additionally, opening of the passage 212 and "depressurization" of the outlet chamber 90 reduces the closing force on the outlet check valve member 180 to permit substantially simultaneous opening of this valve and depressurization of the pump cavity, thereby allowing the diaphragm to relax from any distended position it may be in at the time the pump is stopped. Any liquid disposed in the pump cavity at such time is also forced into the outlet chamber, thence into the auxiliary chamber.

In opening the outlet chamber to the auxiliary chamber the physical structures of the auxiliary chamber, the flange cap and its concentric conduit are of importance. For example, the flow path of liquid from the outlet chamber through the auxiliary chamber is indirect, i.e., tortuous, thereby reducing the likelihood of a sudden jet of hazardous liquid directly from the outlet side of the pump. This feature is further enhanced by providing a discrete void volume within the auxiliary chamber proper that must be filled before liquid will flow from the flange cap conduit. This volume thus functions in the nature of an "energy absorber" to further reduce the likelihood of a jet discharge from the pump when it is opened to atmospheric pressure. Of importance in establishing this tortuous flow path are the grooves 248 in the concave end 236 of the concentric conduit 222 that provide for liquid flow around the spherical valve member 240 while at the same time providing for continued application of pressure applied against the spherical member 240 by the conduit 222 to control the opening and closing of the passage 212.

Additionally, the structure of the flange cap and its concentric conduit, in conjunction with the spherical valve member and its resilient O-ring valve seat, and the threaded engagement of the cap with the auxiliary chamber, provide easy and precise control over the opening of the passage 212, hence the opening of the outlet chamber 90 to atmospheric pressure. Again, this structure contributes to the prevention of a jet discharge of liquid from the pump.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed:

1. In a diaphragm pump including a pump cavity, a distenable diaphragm spanning said cavity, means for distending said diaphragm in forward and backward strokes, inlet and outlet check valves controlling the flow of a liquid through said pump in response to reciprocable distension of said diaphragm, the improvement comprising an outlet chamber located immediately adjacent said outlet check valve, an auxiliary chamber in fluid communication with said outlet chamber and having a wall means and defining a void volume, flange cap means threadably engaging said wall means, conduit means mounted concentrically in said cap means and defining a flow path for the flow of liquid from said auxiliary chamber and, valve means disposed within said auxiliary chamber, said valve means comprising a resilient annular valve seat means and a valve member disposed between the inboard end of said conduit means and said valve seat means whereby the position of said valve member with respect to said valve seat means is selectable by selection of the threaded position of said flange cap means with respect to said wall means of said auxiliary chamber.

2. The improvement of claim 1 and including an inlet chamber and removable inlet and outlet fittings disposed in said inlet and outlet chambers.

3. The improvement of claim 1 and including continuous web means securing said conduit means in substantially concentric relationship to said flange cap means.

4. The improvement of claim 1 wherein said conduit means includes nozzle means on the outboard end thereof for receiving a drainage conduit means.

5. The improvement of claim 1 wherein said passage leading from said outlet chamber extends in a direction substantially perpendicular from said outlet chamber means.

6. The improvement of claim 1 wherein said inboard end of said conduit means is provided with groove means for the flow of liquid therealong.

7. The improvement of claim 6 wherein said inboard end of said conduit means defines a concavity within which said valve member partially resides.

* * * * *